United States Patent [19]

Austin

[11] Patent Number: 5,052,900

[45] Date of Patent: Oct. 1, 1991

[54] PRESSURE RELIEF VALVE FOR POSITIVE PRESSURE PUMPS

[76] Inventor: Jon W. Austin, 1909 E. Camino De Los Ranchos, Phoenix, Ariz. 85022

[21] Appl. No.: 508,641

[22] Filed: Apr. 11, 1990

[51] Int. Cl.[5] ..... F04B 43/12; F04B 49/08

[52] U.S. Cl. ..... 417/309; 417/440; 417/477; 251/6

[58] Field of Search ..... 417/307, 309, 310, 311, 417/440, 474, 475, 476, 477; 137/569, 843; 251/4, 6, 7, 10

[56] References Cited

U.S. PATENT DOCUMENTS

| | | | |
|---|---|---|---|
| 2,245,030 | 6/1941 | Gottesfield et al. | 251/7 |
| 2,819,864 | 1/1958 | Marks | 251/7 |
| 4,470,767 | 9/1984 | Frings et al. | 417/310 |
| 4,828,462 | 5/1989 | McBurnett | 417/310 X |

FOREIGN PATENT DOCUMENTS

| | | | |
|---|---|---|---|
| 107459 | 5/1984 | European Pat. Off. | 137/569 |
| 0204979 | 12/1983 | Fed. Rep. of Germany | 137/843 |
| 0509746 | 11/1976 | U.S.S.R. | 137/843 |
| 1229425 | 5/1986 | U.S.S.R. | 417/477 |

*Primary Examiner*—Louis J. Casaregola
*Assistant Examiner*—E. L. Szczecina, Jr.
*Attorney, Agent, or Firm*—Gregory J. Nelson

[57] ABSTRACT

A pressure relief valve for positive pressure pump systems in which fluid is displaced from the inlet to the outlet of the pump. The pressure relief valve includes a bypass tubing member interconnecting the outlet and a lower pressure area such as the inlet. Pressure limiting means normally occlude the bypass tubing to restrict flow when the outlet pressure of the pump is below a predetermined level and responds to pressure above a predetermined level to shunt fluid from the outlet to the inlet. In the preferred embodiment, the pressure limiting means consists of bar-like members which engage the exterior of the tubing and are biased to compress the bypass tubing to a flow restricting position by elastic bands extending around the bar-like members.

5 Claims, 1 Drawing Sheet

PRESSURE RELIEF VALVE FOR POSITIVE PRESSURE PUMPS

The present invention relates to valves and more particularly to pressure relief valves for positive pressure pumps such as roller pumps and centrifugal pumps. Pumps of this general type have particular application in the medical field for transferring blood and bodily fluids between a patient and an extracorporal device.

Most pumps used for extracorporeal circulation devices are positive pressure pumps such as peristaltic or centrifugal pumps. Pumps of this type are commonly used in open-heart surgery for circulating blood between the patient and the heart-lung machine and for infusing cardioplegic solutions into the coronary arteries to reduce oxygen consumption rates. Pumps of this design are also used in dialysis procedures for transferring blood between a patient and dialyser. Pumps of this type also have various other applications such as the pumping of IV fluids and industrial applications.

Peristaltic pumps are volumetric pumps which progressively compress a fluid tube to propel liquid along the tube under the influence of a rotating member which contacts the tube at spaced-apart points. A principal advantage of pumps of this type is that they are inherently simple having no internal valves. Blood and other fluids pass through a chemically inert tube that may be easily sterilized. The blood or pumped fluid does not come into direct contact with the rotating member of the pump. However, certain disadvantages arise due to the inherent characteristics of these type of pumps when utilized in extracorporeal circuits involving blood, gases, dialysate, drug solutions and cardioplegic solutions. Pumps of this type can develop exceedingly high pressures particularly if there is some resistance to flow or obstruction to flow in the circuit. The excessively high fluid pressures can cause damage to the system and more importantly can cause damage to the patient. Damage to the pumped fluid can also occur within the extracorporeal circuit. For example, blood can be damaged when it encounters high blood pressure in an extracorporeal circuit. The other fluids and gases mentioned above can similarly experience damage or degradation if subjected to extremely high pressure. The various fluids in the extracorporeal circuit should be limited to within specific pressure ranges as determined by the particular procedure and fluid.

Accordingly, there exists a need for a device which will limit the pressure in the extracorporeal circuit of a positive pressure pump.

Briefly, the present invention provides a pressure release valve for positive pressure systems in which fluid is displaced from the inlet to the outlet of a pump such as in a peristaltic pump. The pump system includes a bypass member which is a flexible or compressible tube interconnecting the output of the pump and a lower pressure area such as the pump inlet. Pressure limiting means normally occlude the bypass tube to restrict flow when the outlet pressure of the pump is below a predetermined level. The pressure limiting means will respond to a pressure above a predetermined level to shunt fluid from the outlet to the pump inlet. In the preferred embodiment, the pressure limiting means consists of bar-like members which oppositely engage the exterior of the bypass tube and are urged together to compress the bypass tubing to a flow restricting position by elastic bands extending around the bar-like members.

The above and other objects and advantages of the present invention will become more apparent from the following specification taken in conjunction with the accompanying drawings in which.

Figure 1:
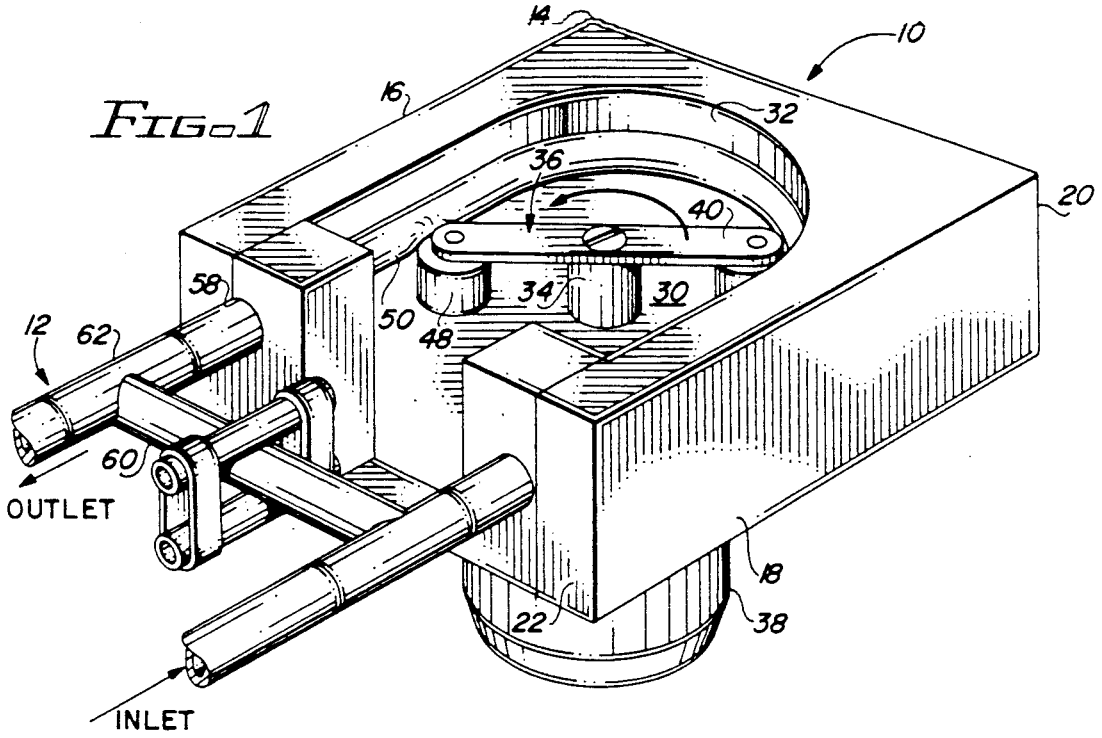
FIG. 1 is a perspective view of a peristaltic pump and portion of the extracorporeal circuit including the relief valve of the present invention.

Turning now to the drawings, FIG. 1 illustrates a typical peristaltic pump 10 with a relief valve 12 of the present invention connected to the extracorporeal circuit. The pump may be typically used to supply blood to a patient on a heart-lung machine, for renal dialysis or for supplying suitable IV or other fluids to the patient. As mentioned above, the system may also be used for industrial pumping applications. The pump 10 includes a housing 14 shown as being generally rectangular having opposite side walls 16 and 18, rear wall 20 and front wall 22. The housing defines an interior chamber 30 having an arcuate surface which forms a stator raceway 32. Drive shaft 34 projects vertically into chamber 30 and carries a rotor head 36. Rotor 36 is provided with oppositely extending arm 40 which is provided with rollers 48 at the opposite ends of the arm.

A pumping element 50 extends in a general U-shape within the pump housing having a section 52 engaging the stator raceway. One end of the pumping element 50 is secured to the pump housing at an inlet 55 in the front wall by a suitable clamp as is well known. Similarly, the opposite end of the pumping element is secured by a clamp to the housing and outlet opening 58. As the drive shaft rotates, rollers 48 are brought into contact with the pumping section and progressively compress the pumping element against the raceway 32 forcing fluid through the pumping element to be discharged at the outlet 58. Medical pumps of this general type are typified by the Sarns Roller Pump and the Sarns Centrifugal Pump manufactured by Sarns, Division of Minnesota Mining and Manufacturing.

The extracorporeal pressure relief valve is shown connected in a shunt or a bypass line 60 extending between the inlet and outlet of the pump. In some applications, it may be preferable to direct or shunt high pressure fluid to a lower pressure area other than the inlet such as a reservoir or the like. The bypass, as is the pumping element, is constructed from a relatively thin-walled elastic tubing material such as rubber, elastomer, silicon rubber, silastic or similar material which is suitably flexible. For example, in medical applications this tubing may be a polyurethane such as that sold under the trademark "Silastic", typically having a 3/16" to ⅜" OD with adequate flexibility. The shunt or bypass line may be connectors 62 as are well known in the medical and industrial applications.

Figure 2:
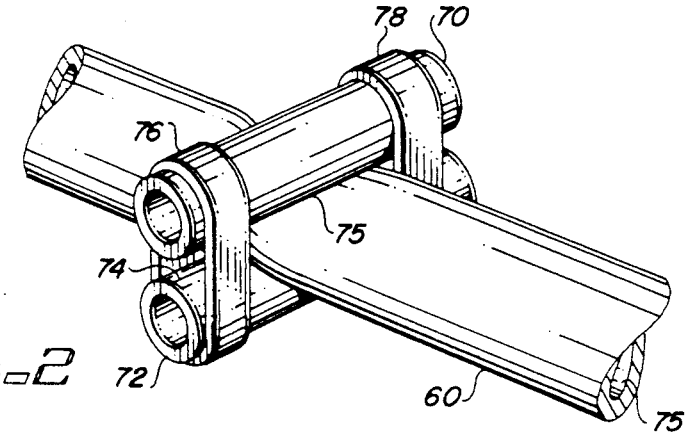
FIG. 2 is a perspective showing the relief valve of the present invention attached to a portion of the extracorporeal tubing circuit.
Figure 3:
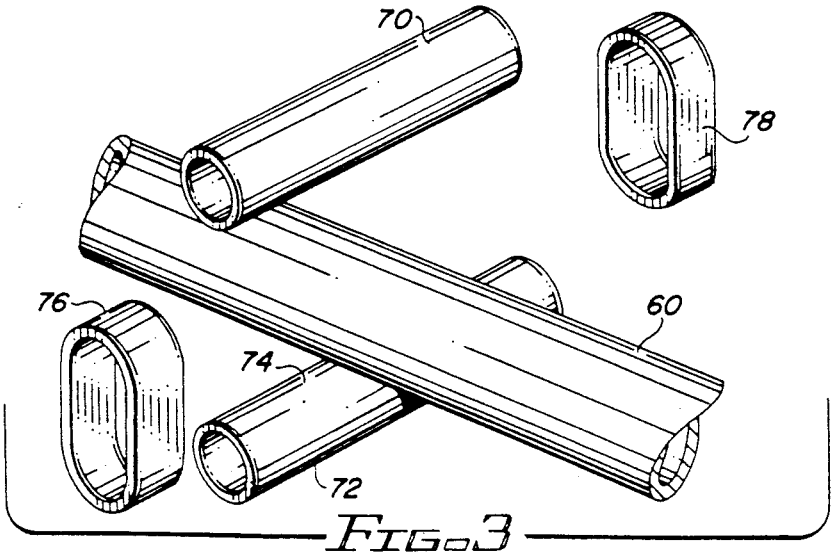
FIG. 3 is an exploded view of the relief valve of the present invention.

The pressure relief valve 12, as best in FIGS. 2 and 3, consists of two oppositely disposed compression members 70 and 72. The two compression members are arranged parallel to one another on opposite sides of the bypass line 60 and are shown as being round or cylindrical in cross section having compression surfaces 74 which compress or occlude the flexible bypass line 60. The compression members extend or project beyond the periphery of the side walls of the bypass line 60. The compression bars are elastically biased together by elastic biasing means 76 and 78 disposed adjacent the outer ends of the compression bars. The biasing means are shown in the form of elastic bands having a predetermined width, length and elasticity. As shown in FIG. 2, the biasing members will exert sufficient compressive force, that is a force tending to pull the two compression bars together, to fully occlude the bypass line in area 75 under normal operating conditions. When the pressure in the bypass line 60 exceeds a predetermined setting, the fluid pressure will overcome the biasing force or closing force allowing the compression member to separate permitting fluid to flow through the lumen 75 of the bypass tube from the outlet 50 to the inlet 55.

The pressure setting, that is the pressure at which the valve will operate allowing fluid flow through the bypass line, can be controlled by various adjustments. For example, the area of the compression surface 74 engaging the bypass line can be varied. Also, as shown, the shape of this surface is generally curved but may be made planar. The shape and area of the surfaces will effect the opening characteristics of the valve.

The material of the elastic biasing members will also affect the operating characteristics of the band. For example, the thickness and the width of the elastic bands may be varied as desired to achieve the proper predetermined opening pressure.

Similarly, the type of material and wall thickness of the bypass line may also be varied to achieve the desired characteristics.

The advantage of the relief valve of the present invention is that it is simple and easy to install. By adjustment of the parameters above, the opening characteristics of the valve can be adjusted or set within predetermined ranges. When the outlet pressure exceeds the predetermined limit, the valve of the present invention functions to shunt fluid from the outlet of the pump to the inlet thereby avoiding damage to the apparatus, patient or fluid being pumped.

It will be apparent that the valve of the present invention can be used with different styles and models of positive pressure pumps. Although the invention has been described with reference to medical applications, the valve may be used with industrial applications such as the handling and pumping of corrosive or hazardous fluids. The valve, bypass line and fittings may be easily installed at the outlet or inlet of the pump. In the case where sterile requirements exist, these tubing or fitting components may be provided in sterile condition. Note that the valve itself is external to the fluid so that no contact with the fluid other than within the confines of the bypass system occurs. The valve and bypass system is easily attached to the existing peristaltic pump and the characteristics of the valve may be easily adjusted by changing the biasing members or the position of the biasing members to the compression occluding members.

As pointed out above, various components of the valve can be adjusted in accordance with the predetermined desired pressure limits of the operating system.

It will be obvious to those skilled in the art to make various changes, alterations and modifications to the device of the present invention. To the extent that these changes, alterations and modifications do not depart from the spirit and scope of the appended claims, they are intended to be encompassed therein.

I claim:

1. A pressure relief valve for a positive pressure pump having an outlet and an outlet which creates a pressure increase from the inlet to the outlet comprising:

(a) flexible, compressible bypass tubing member having a lumen connected to said outlet and discharging at a lower pressure area;

(b) pressure limiting means associated with said bypass tubing member including compression means engaging said bypass tubing member, said compression means comprising oppositely disposed bar members extending peripherally beyond said bypass member; and (c) elastic members extending between said oppositely disposed bar members exerting a predetermined continuous substantially constant compressive force on said compression means to occlude said lumen when pressure in said bypass tubing member is below a predetermined value and to permit flow through said bypass tubing member when said pressure exceeds a predetermined value.

2. The pressure relief valve of claim 1 wherein said elastic members comprise band-like members extending around said bars at opposite sides of the bypass tubing

3. The pressure relief valve of claim 2 wherein said bars are generally circular in cross section.

4. The pressure relief valve of claim 2 wherein said valve may be calibrated by varying the elastic characteristics of the said band-like members.

5. The pressure relief valve of claim 1 wherein said pump is a peristaltic pump.

* * * * *